US008197639B2

(12) United States Patent
Snekkenes

(10) Patent No.: US 8,197,639 B2
(45) Date of Patent: Jun. 12, 2012

(54) VAPOUR PHASE DIGESTER AND A METHOD FOR CONTINUOUS COOKING

(75) Inventor: Vidar Snekkenes, Oslo (NO)

(73) Assignee: METSO PAPER Sweden AB, Karlstad (SE)

( * ) Notice: Subject to any disclaimer, the term of this patent is extended or adjusted under 35 U.S.C. 154(b) by 164 days.

(21) Appl. No.: 12/526,327

(22) PCT Filed: Feb. 19, 2008

(86) PCT No.: PCT/SE2008/050195

§ 371 (c)(1),
(2), (4) Date: Nov. 26, 2009

(87) PCT Pub. No.: WO2008/103124

PCT Pub. Date: Aug. 28, 2008

(65) Prior Publication Data

US 2010/0326611 A1 Dec. 30, 2010

(30) Foreign Application Priority Data

Feb. 23, 2007 (SE) ..... 0700436

(51) Int. Cl.
*D21C 7/00* (2006.01)
*D21C 7/06* (2006.01)

(52) U.S. Cl. ..... 162/17; 162/19; 162/41; 162/43; 162/44; 162/52; 162/63; 162/237; 162/246; 162/248; 162/251

(58) Field of Classification Search ..... 162/17, 162/41, 43, 44, 52, 63, 237, 246, 248, 251
See application file for complete search history.

(56) References Cited

U.S. PATENT DOCUMENTS

| | | | | |
|---|---|---|---|---|
| 5,679,217 | A * | 10/1997 | Outzen et al. | 162/19 |
| 6,159,336 | A * | 12/2000 | Engstrom et al. | 162/17 |
| 6,203,662 | B1 * | 3/2001 | Snekkenes et al. | 162/17 |
| 2004/0112554 | A1 * | 6/2004 | Snekkenes et al. | 162/19 |
| 2007/0187052 | A1 * | 8/2007 | Snekkenes | 162/17 |

OTHER PUBLICATIONS

Tran, Characterisation of a conventional Kamyr continuous digester producing hardwood kraft pulp, Appita Journal, 2005,vol. 59, No. 1, pp. 22-27. Abstract.*

* cited by examiner

*Primary Examiner* — Eric Hug
*Assistant Examiner* — Peter Chin
(74) *Attorney, Agent, or Firm* — Rolf Fasth; Fasth Law Offices

(57) ABSTRACT

The system and method reduce the liquid/wood ratio at the top of a vapor phase digester in a continuous digester plant. Chips that are to be cooked in the vapor phase digester are fed as a mixture of chips and liquid at a liquid/wood ratio that exceeds 8:1 in a transfer line to an inverted top separator arranged at the top of the vapor phase digester. The top separator feeds the chips upwardly. More than 50% of the liquid content of the mixture of chips and liquid is withdrawn in the top separator and the remaining liquid is fed out from the top separator to the top of the vapor phase digester. A pile of chips and a liquid volume are established at the top, wherein the pile of chips is disposed above the liquid surface of the liquid volume.

13 Claims, 2 Drawing Sheets

VAPOUR PHASE DIGESTER AND A METHOD FOR CONTINUOUS COOKING

PRIOR APPLICATION

This application is a U.S. national phase application based on International Application No. PCT/SE2008/050195, filed 19 Feb. 2008, claiming priority from Swedish Patent Application No. 0700436-9, filed 23 Feb. 2007.

TECHNICAL AREA

The present invention concerns a method for the continuous cooking of chemical cellulose pulp in a vapor phase digester.

The invention also concerns a vapor phase digester for the continuous cooking of chips.

BACKGROUND AND SUMMARY OF THE INVENTION

In association with the continuous cooking of chemical cellulose pulp in a vapour phase digester, pre-treated chips are fed to the top of the vapour phase digester as a mixture of chips and liquid. The mixture of chips and liquid undergoes a dewatering process at the top of the digester in what is known as an "inverted top separator", which feeds the mixture in an upwards direction. An example of such an inverted top separator is shown in SE 511850. Chips are fed vertically upwards in the inverted separator with the feed screw. The major part of the mixture of chips and liquid is withdrawn through vertically arranged withdrawal strainers.

When the chips pass the upper edge of the separator, they fall down through a vapour phase at the top of the digester. The chips subsequently become located uppermost in a column of chips that is not submerged in liquid. However, a liquid level is established under the column of chips. Steam is added directly to the vapour phase.

A number of withdrawal strainers are arranged under the liquid level for the withdrawal of liquor. These are arranged primarily for the purpose of top, intermediate and bottom circulation flows. The upper strainer (not mentioned in the patent) is arranged such that it can increase locally the liquid/wood ratio at the top of the digester, such that it is possible in this way to adjust the alkali concentration in the digester. This upper strainer is usually also denoted as the "trim screen".

The withdrawal of liquid from the fluid level through withdrawal strainers that is subsequently sent to the preceding chips treatment stage in the digester system is known. SE 504 644 C2 shows how liquor is withdrawn at different levels in the digester through upper, intermediate and lower withdrawal strainers 26, 27, 28.

The upper withdrawal strainer 26 is not described in detail in the patent, but this is an adjuster strainer or a trim screen, where the purpose of the withdrawal is primarily to equilibrate the concentration of alkali in the cooking process, and to adjust the temperature, by increasing the liquid/wood ratio at the top of the digester.

It is not unusual in the continuous digesters used today that a digester that is dimensioned for around 500 tonnes/day is run at a higher load, giving a production capacity of as much as 1,500 tonnes/day. This leads to the top separators being underdimensioned, and unable to cope with the withdrawal of the large quantities of liquid that are required in order for it to be possible to operate the cooking process in an advantageous manner. This leads to it being necessary to exchange the top of the digester for a top with a larger diameter and a larger top separator, in order to cope with the new conditions. Not only is this a very expensive measure, it is also work that take a long time and gives rise to extended interruptions in operation.

A first aim of the invention is to offer a method and a vapour phase digester that partially or fully solves the problems and disadvantages of today's continuous digester plants, where digesters are run at excess load, as described above in the summary of the prior art technology.

A second aim is to achieve a method and a vapour phase digester in order to reduce the liquid/wood ratio at the top of the vapour phase digester.

A third aim is to offer a solution for dewatering the top of the digester in a vapour phase digester, without needing to exchange existing top separators.

A fourth aim is to offer a vapour phase digester that can be run at more advantageous process conditions.

The objects described above are achieved with the method and with the vapor phase digester according to the present invention.

The suggested invention offers a method and a vapour phase digester in which the principal aim of the invention is to reduce the liquid/wood ratio at the top of a vapour phase digester in a continuous digester plant.

This is achieved through the arrangement of at least one withdrawal strainer at the liquid volume of the digester close to the liquid surface, where the chips have had only a short retention time in the liquid volume. Liquid is withdrawn from the withdrawal strainer and sent to preceding chips treatment stages.

The withdrawal strainer acts in principle as an extra top separator that allows a dewatering at the top of the digester. The upper edge of the withdrawal strainer is arranged at a distance under the liquid surface, where the distance is less than 0.5× the diameter of the withdrawal strainer. This can be expressed in an alternative manner: the withdrawal takes place at a distance where the chips have had a retention time in the liquid part of 0.1-15 minutes.

The following positive properties relative to prior art technology are achieved with the invention:

- the liquid/wood ratio at the top of the digester is considerably reduced.
- the vapour phase digester can be run at a higher loading.
- under dimensioned vapour phase digesters can be rebuilt such that they comprise a withdrawal strainer as specified by the patent claims, to a low cost relative to what the cost would be for exchanging the complete top separator.

DETAILED DESCRIPTION OF THE INVENTION

Figure 1:
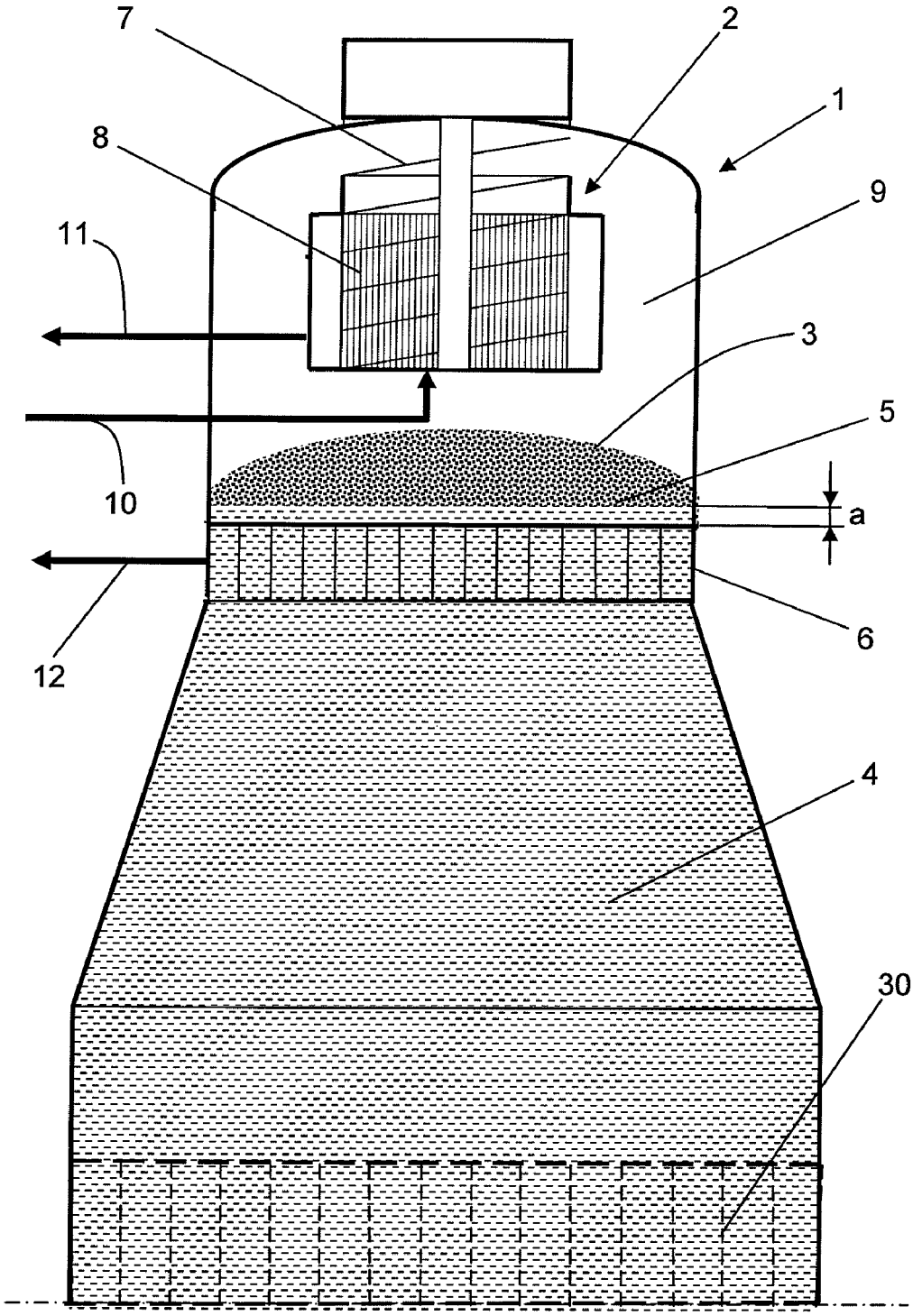
FIG. 1 shows the top of a vapour phase digester in which the withdrawal strainer 6 according to the invention is included.
Figure 2:
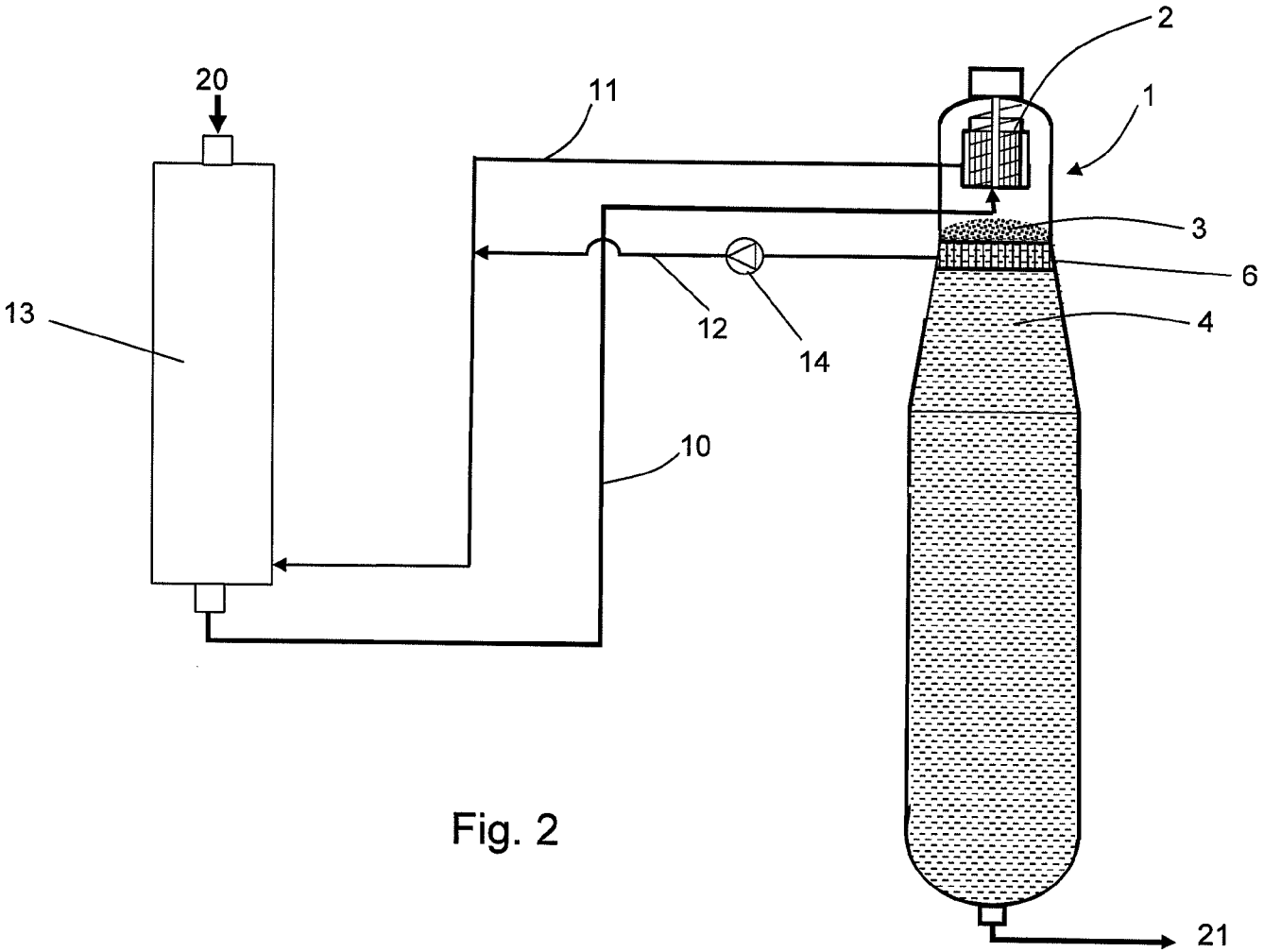
FIG. 2 shows a digester system consisting of the vapour phase digester 1 according to the invention and a preceding impregnation vessel 13.

FIGS. 1 and 2 show a method for the continuous cooking of chips to produce cellulose pulp in a vapour phase digester 1. The chips 20 that are to be cooked in the vapour phase digester 1 are first impregnated in an impregnation vessel 13, before the impregnated chips are fed into a transfer line 10 to the top of the vapour phase digester with a mixture of chips and liquid at a liquid/wood ratio that exceeds 8:1.

The mixture of chips and liquid undergoes a dewatering process on its input at the top of the digester in what is known as an "inverted top separator" 2, which feeds the mixture in an upwards direction. The chips are fed vertically in the inverted top separator 2 with a feed screw 7. A first withdrawal liquid is withdrawn through vertical withdrawal strainers 8 arranged in the top separator 2, and this withdrawal constitutes an amount that is greater than 50% of the liquid content of the mixture of chips and liquid.

This first withdrawal liquid is returned to preceding impregnation vessels 13 in a first return line 11. This first withdrawal liquid exceeds an amount of 5 $m^3$ per tonne of chips in the mixture of chips and liquid.

The remaining mixture of chips and liquid with chips and the remaining liquid is fed out from the top separator 2 by passing the upper edge of the top separator 2. It subsequently falls down through a vapour phase 9 at the top of the digester 1. Steam is added through a line (not shown in the drawings) to the vapour phase 9 in the digester in order to heat the chips that fall down over the edge of the top separator 2.

The chips subsequently are located uppermost in a pile 3 of chips. A liquid volume 4 is established under the pile of chips, where the pile 3 of chips lies above the liquid surface 5 of the liquid volume 4. At least one withdrawal strainer 6 is arranged under the liquid surface 5, in the liquid volume 4. A second withdrawal liquid is withdrawn from the withdrawal strainer 6 to a second return line 12, with the aim of reducing the liquid/wood ratio at the top of the digester. This second withdrawal liquid exceeds an amount of 2 $m^3$ per tonne of chips in the mixture of chips and liquid. A pressurising means 14 is arranged in the second withdrawal line 12 in order to place the second withdrawal liquid under pressure, as required, before it is returned to preceding chips treatment stages. The pressurising means 14 may be constituted by, for example, a pump, an ejector or a compressor.

FIG. 2 shows that the first withdrawal liquid is mixed in the first return line 11 with the second withdrawal liquid in the second return line 12, before they are returned to the bottom of the preceding impregnation vessel 13 at one common position. Alternatively, the first and the second withdrawal liquids may be returned to different positions in the impregnation vessel 13 (not shown in the drawings).

In one preferred embodiment of the invention, the withdrawal of the second withdrawal liquid is taken from the withdrawal strainer 6 when the chips have had a retention times in the liquid volume of 0.1-15 minutes, preferably 0.1-10 minutes, and most preferably 0.1-5 minutes.

In a further preferred embodiment of the invention, the upper edge of the withdrawal strainer 6 is arranged at a distance a under the liquid surface 5, where the distance a is less than 0.5× the diameter of the withdrawal strainer, preferably less than 0.3× the diameter of the withdrawal strainer, and most preferably less than 0.2× the diameter of the withdrawal strainer.

After the cooking process in the vapour phase digester 1 has been completed, the cellulose pulp 21 is fed out from the digester through an outlet arranged at the bottom of the vapour phase digester.

FIG. 1 shows furthermore with dashed lines a lower withdrawal strainer 30 that is not a part of the invention for which a patent is sought. The lower withdrawal strainer 30 illustrates the location of a conventional withdrawal strainer, and it is located below the cone-shaped part of the digester. The principal purpose of the conventional withdrawal strainer 30 is to give an improved alkali profile by increasing locally the liquid/wood ratio at the top of the digester. This contrasts directly with the invention for which a patent is sought, where the principal purpose is to give a lower liquid/wood ratio at the top of the digester. When the chips pass the withdrawal strainer 30, the chips have had a significant retention time in the liquid volume, which is not the case for the withdrawal strainer 6 according to the invention.

The following positive properties relative to prior art technology are achieved with the invention:

- the liquid/wood ratio at the top of the digester is considerably reduced.
- the vapour phase digester can be run at a higher loading.
- under dimensioned vapour phase digesters can be rebuilt such that they comprise a withdrawal strainer as specified by the patent claims, to a low cost relative to what the cost would be for exchanging the complete top separator.

While the present invention has been described in accordance with preferred compositions and embodiments, it is to be understood that certain substitutions and alterations may be made thereto without departing from the spirit and scope of the following claims.

The invention is not limited to the embodiments described above: several variants are possible within the framework of the attached patent claims.

The invention claimed is:

1. A method for the continuous cooking of chemical cellulose pulp in a vapor phase digester, comprising:

feeding a mixture of chips, that are to be cooked in a vapor phase digester, and a liquid to a top of the digester, the mixture fed to the digester having a liquid/wood ratio that exceeds 8:1, the mixture undergoing a dewatering process at the top of the digester in an inverted top separator, the inverted top separator feeding the mixture in an upward direction, withdrawing a first withdrawal liquid at the top separator that constitutes more than 50% of a liquid content of the mixture, feeding the chips and a remaining portion of the liquid out from the top separator to the top of the digester, establishing a pile of chips and a liquid volume inside the digester, the pile of chips being disposed above a liquid surface of the liquid volume, providing a withdrawal strainer and positioning the withdrawal strainer at a distance (a) from the liquid surface, the distance (a) being less than 0.5× of a diameter of the second withdrawal strainer, retaining the chips in the liquid volume for 0.1-15 minutes, the withdrawal strainer withdrawing a second withdrawal liquid below the liquid surface, the withdrawing of the second withdrawal liquid reducing the liquid/wood ratio at the top of the digester, and returning the second withdrawal liquid to the preceding chips treatment stage prior to the digester.

2. The method according to claim 1, wherein the withdrawal of the second withdrawal liquid takes place after a retention time in the liquid volume of 0.1-10 minutes.

3. The method according to claim 1, wherein the withdrawal of the second withdrawal liquid takes place after a retention time in the liquid volume of 0.1-5 minutes.

4. The method according to claim 1 wherein the first and the second withdrawal liquids are mixed before the first and second withdrawal liquids are returned to preceding chips treatment stages in the digester.

5. The method according to claim 1 wherein the first and the second withdrawal liquids are returned to different positions in preceding chips treatment stages in the digester.

6. The method according to claim 1 wherein the first withdrawal liquid exceeds an amount of 5 $m^3$ per tonne of chips in the mixture of chips and liquid.

7. The method according to claim 1 wherein the second withdrawal liquid exceeds an amount of 2 $m^3$ per tonne of chips in the mixture of chips and liquid.

8. A vapor-phase digester system for continuously cooking chips, comprising:

providing a vapor-phase digester containing chips and a liquid volume, the liquid volume having a liquid surface, means for feeding chips, that are to be cooked in a vapor-phase digester, in a transfer line to a top of the digester in a mixture of chips and liquid to an inverted top separator arranged at the top of the digester, the inverted top separator having means for feeding the chips upwardly, the top separator having means for withdrawing a first withdrawal liquid, the top separator being in fluid communication with a first return line extending to a preceding chips treatment stage prior to the vapor-phase digester, the top separator having means for feeding out remaining chips and remaining liquid from the top separator to the top of the digester, the top of the digester having a pile of chips and a liquid volume established therein, the pile of chips being disposed above the liquid surface of the liquid volume, the digester having a withdrawal strainer disposed below the liquid surface, an upper edge of the withdrawal strainer being arranged at a distance (a) below the liquid surface, the distance (a) being less than 0.5 of a diameter of the withdrawal strainer, and the withdrawal strainer having means for withdrawing a second withdrawal liquid to a second return line in fluid communication with the first return line and means for sending the second withdrawal liquid to the first return line via the second return line.

9. The vapor phase digester system according to claim 8 wherein an upper edge of the withdrawal strainer is arranged at a distance (a) that is less than 0.3×the diameter of the withdrawal strainer below the liquid surface.

10. The vapor phase digester system according to claim 8 wherein an upper edge of the withdrawal strainer is arranged at a distance (a) that is less than 0.2×the diameter of the withdrawal strainer below the liquid surface.

11. The vapor phase digester system according to claim 8 wherein the digester has means for mixing the first and the second withdrawal liquids before the first and the second liquids are returned to preceding chips treatment stages in the digester.

12. The vapor phase digester system according to claim 8 wherein the digester has means for returning the first and the second withdrawal liquids to different locations in preceding chips treatment stages in the digester.

13. The vapor-phase digester system according to claim 8 wherein the digester has the first return line extending from the top of the digester to an impregnation vessel.

* * * * *